US009512974B2

(12) United States Patent
Otsubo

(10) Patent No.: US 9,512,974 B2
(45) Date of Patent: Dec. 6, 2016

(54) VEHICULAR LAMP

(75) Inventor: Takayuki Otsubo, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 557 days.

(21) Appl. No.: 13/610,453

(22) Filed: Sep. 11, 2012

(65) Prior Publication Data

US 2013/0077334 A1 Mar. 28, 2013

(30) Foreign Application Priority Data

Sep. 26, 2011 (JP) ..... P2011-209164

(51) Int. Cl.
*F21S 8/10* (2006.01)

(52) U.S. Cl.
CPC ..... *F21S 48/211* (2013.01); *F21S 48/215* (2013.01)

(58) Field of Classification Search
CPC ..... F21S 48/211; F21S 48/215
USPC ..... 362/309, 546
See application file for complete search history.

(56) References Cited

U.S. PATENT DOCUMENTS 5,546,285 A * 8/1996 Takikawa et al. ..... 362/509
2008/0259629 A1* 10/2008 Takuwa ..... 362/548

FOREIGN PATENT DOCUMENTS

| | | | |
|---|---|---|---|
| JP | P2001-80412 | A | 3/2001 |
| JP | P2002-245813 | A | 8/2002 |
| JP | P2005-310584 | A | 11/2004 |
| JP | 2006-147330 | A | 6/2006 |
| JP | P2010-015910 | A | 1/2010 |
| KR | 10-2010-0002455 | A | 1/2010 |
| KR | 10-2011-0076882 | A | 1/2011 |

* cited by examiner

*Primary Examiner* — Sharon Payne
(74) *Attorney, Agent, or Firm* — DLA Piper LLP (US)

(57) ABSTRACT

A vehicular lamp (1) including a lamp easing (4) formed by a lamp housing (2) having an opening (2*a*) on at least one side and a cover (3) attached to the lamp housing and closing the opening, and a tight source unit (6) disposed in the lamp casing and having a light source (8) that emits light, wherein the light source unit has a wiring board (7) that has a first surface (9*a*) and a second surface (10*a*) which face different directions and an electronic part that is mounted at least on the first surface and includes the light source, and a holding protrusion (11) that holds the electronic part is provided on the first surface of the wiring board.

8 Claims, 4 Drawing Sheets

VEHICULAR LAMP

BACKGROUND OF THE INVENTION

1. Field of the Invention

The present invention relates to vehicular lamps and more particularly to a vehicular lamp structure in which a holding protrusion that holds an electronic part is provided on a surface of a wiring board having thereon the electronic part.

2. Description of the Related Art

There are vehicular lamps in which a light source unit having a light source such as a semiconductor light emitting element that emits light is provided in a lamp casing formed by a cover and a lamp housing.

One type of such light source units includes an electronic part such as a light source, a resistive element, etc. in addition to a wiring board on which a circuit pattern is formed and the electronic parts are mounted (see Japanese Patent Application Laid-Open (Kokai) No. 2006-147330, for example).

A vehicular lamp described in Japanese Patent Application Laid-Open (Kokai) No, 2006-147330 provides, among others, an increased freedom of design choice by forming a plurality of mounting surfaces, which face different directions, on a wiring board, and mounting electronic parts on the plurality of mounting surfaces. More specifically, a light source is mounted on one mounting surface of the wiring board, and a resistive element is mounted on the other mounting surface (see FIG. 5 of Japanese Patent Application Laid-Open (Kokai) No. 2006-147330).

In the light source unit described above, the electronic parts are typically bonded to the wiring board by reflow soldering. In the reflow soldering, the electronic parts are placed on solder paste applied to the wiring board, and in this state, the solder paste is melted by heating in a reflow oven and then the solder paste is solidified by cooling, thus allowing the electronic parts to be soldered to the wiring board.

In the vehicular lamp described in Japanese Patent Application Laid-Open (Kokai) No. 2006-147330, however, since the two mounting surfaces facing different directions are formed on the wiring board, at least one of the mounting surfaces is tilted with respect to the horizontal direction when soldering is performed. Accordingly, when the light source or the resistive element is set on the wiring board or when the solder paste is heated in the reflow oven, the light source or the resistive element that is to be mounted on the tilted mounting surface may be displaced with respect to the wiring board or may drop from the wiring board due to the gravity.

BRIEF SUMMARY OF THE INVENTION

It is, accordingly, an object of the present invention to solve the above problems and to prevent displacement of electronic parts with respect to a wiring board and dropping of the electronic parts from the wiring board.

In order to solve the above problems, a vehicular lamp of the present invention includes: a lamp casing formed by a lamp housing having an opening on at least one side, and a cover attached to the lamp housing and closing the opening; and a light source unit disposed in the lamp easing and having a light source that emits light, and in this vehicular lamp structure, the light source unit has a wiring board, which includes a first surface and a second surface that face different directions, and an electronic part, which includes the light source and is mounted at least on the first surface, and a holding protrusion that holds the electronic part is provided on the first surface of the wiring board.

In the vehicular lamp of the present invention that includes the above-described light source unit, the electronic part is held by the holding protrusion with the first surface tilted with respect to a horizontal direction.

Accordingly, since the electronic part is held by the holding protrusion that has the first surface tilted with respect to the horizontal direction, displacement of the electronic part with respect to the wiring board and dropping of the electronic part from the wiring board are prevented during the soldering process.

Furthermore, in the present invention, the electronic part is a semiconductor light emitting element provided as the light source, and the height of the holding protrusion from the first surface is lower than that of the semiconductor light emitting element from the first surface.

Accordingly, the holding protrusion does not block so much of the light emitted from the semiconductor light emitting element, and a satisfactory lighting state of the semiconductor light emitting element is ensured.

In addition, in the present invention, when mounted on the first surface, the electronic part set at a position where the electronic part is pressed against the holding protrusion by gravity.

Accordingly, displacement of the electronic part with respect to the wiring board and dropping of the electronic part from the wiring board are prevented with a simple configuration.

Further, in the present invention, the wiring board is a molded interconnection device.

Accordingly, since the wiring board having a three-dimensional circuit pattern etc. formed thereon can be used, the degree of freedom for design choice with respect to the light source unit is high.

Furthermore, in the present invention, an optical part of the vehicular lamp can be used as the holding protrusion.

Accordingly, a dedicated holding protrusion that is designed to prevent displacement of electronic parts with respect to the wiring board and dropping of the electronic parts from the wiring board is not required. Thus, displacement of electronic parts with respect to the wiring board and dropping of the electronic parts from the wiring board are prevented with a simplified structure.

DETAILED DESCRIPTION OF THE INVENTION

Hereinafter, a best mode for carrying out a vehicular lamp according to the present invention will be described with reference to the accompanying drawings.

In the best mode described below, the vehicular lamp of the present invention is applied to a vehicular lamp that is a so-called "rear combination lamp" and functions as a turn signal lamp, a tail lamp, a stop lamp, etc. The range of application of the vehicular lamp according to the present invention is not limited to the rear combination lamp, and the vehicular lamp according to the present invention is widely applicable to various vehicular lamps such as a headlamp, a clearance lamp, a turn signal lamp, a tail lamp, a stop lamp, etc.

A vehicular lamp 1 is disposed and mounted on both right and left sides of the rear end of a vehicle body.

Figure 1:
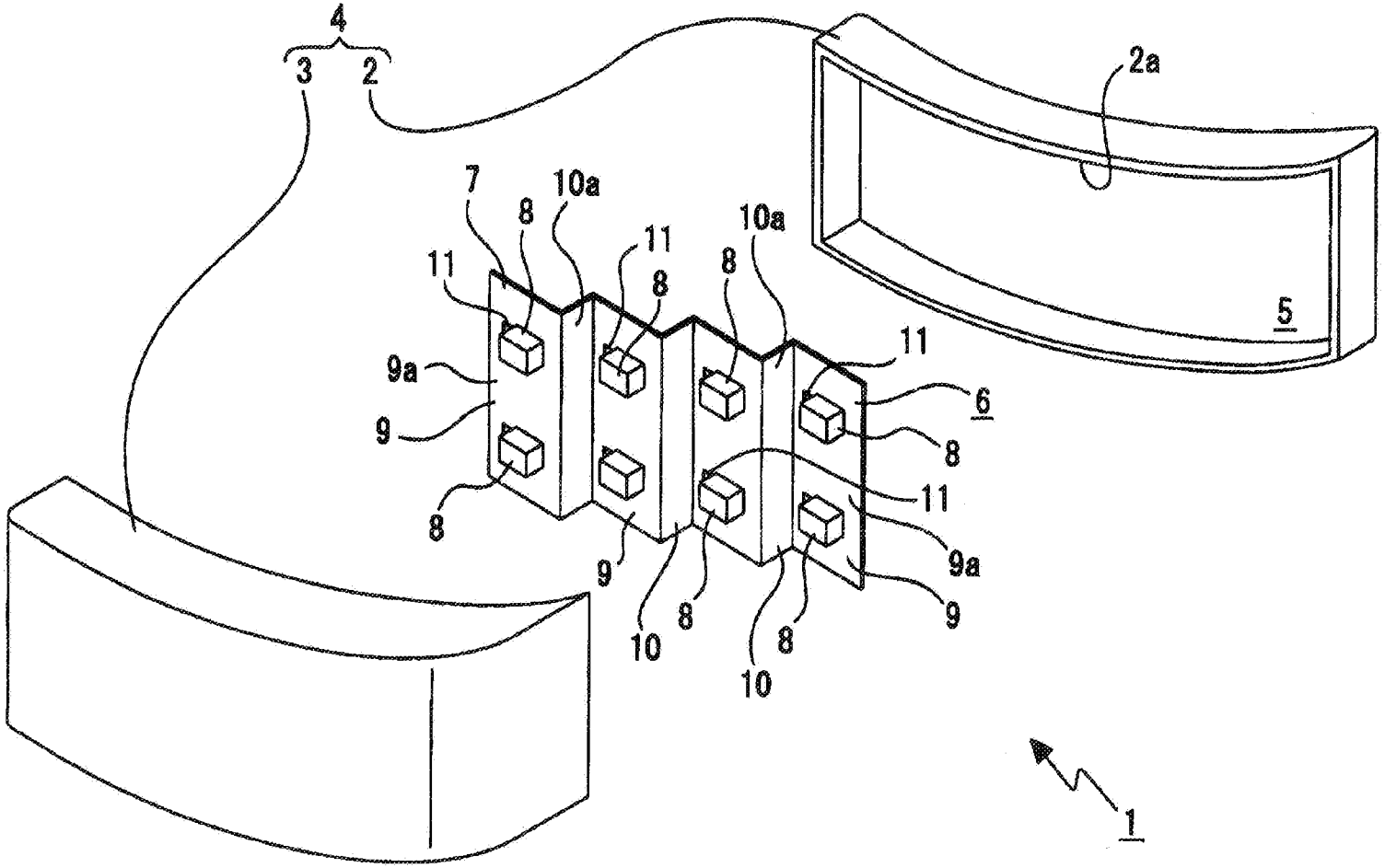
FIG. 1 is an exploded perspective view of a vehicular lamp according to the present invention showing, together with FIGS. 2 to 6, a best mode thereof.

As shown in FIG. 1, the vehicular lamp 1 of the present invention includes a lamp housing 2, having a recess shape and opening rearward, and a cover 3, closing the opening 2*a* of the lamp housing 2. The lamp housing 2 and the cover 3 form a lamp casing 4. The internal space of the lamp casing 4 makes a lamp chamber 5.

A light source unit 6 is provided in the lamp chamber 5. The light source unit 6 includes a wiring board 7, a plurality of light sources 8 mounted on the wiring board 7, a resistive element (not shown) mounted on the wiring board 7, etc. The light sources 8 and the resistive element are the electronic parts.

Figure 2:
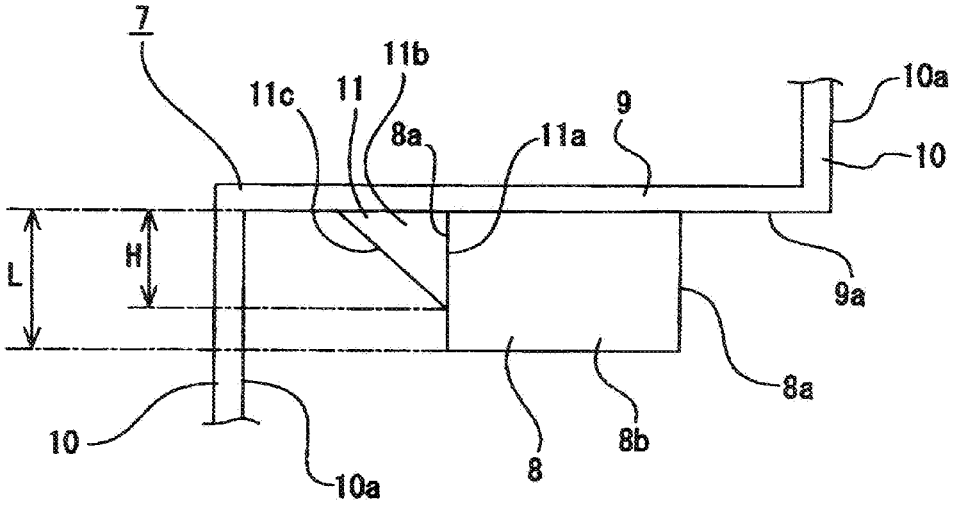
FIG. 2 is an enlarged top view of a part of the light source unit thereof.

As shown in FIGS. 1 and 2, the wiring hoard 7 is formed in a stepped configuration with mounting portions 9 and connecting portions 10. The mounting portions 9 and the connecting portions 10 face different directions from each other, and they are each formed in a plate shape and alternately and continuously form the wiring board 7. An outward facing surface of each mounting portion 9 is formed as a first surface 9*a*, and an outward facing surface of each connecting portion 10 is formed as a second surface 10*a*, and the neighboring first and second surfaces 9*a* and 10*a* make substantially a right angle with each other.

Two holding protrusions 11 are provided on the first surface 9*a* of each mounting portion 9 so as to be separately located from each other in the vertical direction. Each holding protrusion 11 is, as best seen from FIG. 2, formed in, for example, a triangular prism shape, and outer surfaces of each holding protrusion 11 are formed by a rectangular contact surface 11*a* extending perpendicularly to the first surface 9*a* and facing substantially the same direction as the second surface 10*a*, by right triangle-shaped side surfaces 11*b* extending perpendicularly to the first surface 9*a* and being continuous with both side edges of the contact surface 11*a*, and by a rectangular tilted surface 11*c* tilted with respect to the first surface 9*a* (see FIGS. 2 and 3). The side surfaces 11*b* are parallel to each other in a direction perpendicular to a direction along which the first surfaces 9*a* and the second surfaces 10*a* are arranged. In other words, the rectangular contact surface 11*a* and tilted surface 11*c* are provided vertically, and the triangle-shaped side surfaces 11*b* are provided horizontally. Both (vertical) edges of the tilted surface 11*c*, in the direction along which the first surfaces 9*a* and the second surfaces 10*a* are arranged, are continuous with one edge of the contact surface 11*a* and the first surface 9*a*.

The wiring board 7 is, for example, a molded interconnection device (MID), and a circuit pattern (not shown) is formed on the wiring board 7. The "MID" refers to a part produced by three-dimensionally forming a circuit pattern, an electrode, etc. on a surface such as an outer surface, an inner surface, etc. of an injection-molded article having a shape with protrusions and recesses, a curved shape, a stepped shape, etc. In the wiring board 7, a base portion on which the circuit pattern is formed is made of a resin material by injection molding. The holding protrusions 11 are formed integrally with, for example, the base portion of the wiring board 7.

As described above, the wiring board 7 is an MID. Accordingly, the degree of freedom for design choice with respect to the light source unit 6 can increase because the wiring board 7 that has the three-dimensional circuit pattern etc. formed thereon can be employed.

In addition, as described above, since the holding protrusions 11 are integrally formed on the base portion of the wiring board 7, the number of manufacturing steps can be reduced, and thus the manufacturing cost can be reduced as well.

Although the base portion of the wiring board 7 is made of the resin material in the above example, the base portion of the wiring board 7 may be made of a material other than the resin material. For example, the wiring board can be flexible print circuits (FPC) whose base portion is a metal base. In this case, each holding protrusion 11 is formed by cutting and raising of a metal base.

Semiconductor light emitting elements such as light emitting diodes (LEDs) are used as the light sources 8. The light sources 8 are each formed in, for example, a rectangular parallelepiped shape, and the outer peripheral surfaces of each light source 8 are formed by a pair of first side surfaces 8*a* that are parallel to each other, and a pair of second side surfaces 8*b* that are parallel to each other. Two light sources 8 are mounted on each of the first surface 9*a* of the wiring board 7 so as to be separately located from each other in the vertical direction.

Each light source 8 is disposed on the wiring board 7 with one of the first side surfaces 8*a* in contact with the contact surface 11*a* of the holding protrusion 11. As seen from FIG. 2, the height L of the light source 8 from the first surface 9*a* of the wiring board 7 is greater than the height H of the holding protrusion 11 from the first surface 9*a*. Each light source 8 is connected to the circuit pattern via solders 12 (see FIG. 3).

Figure 3:
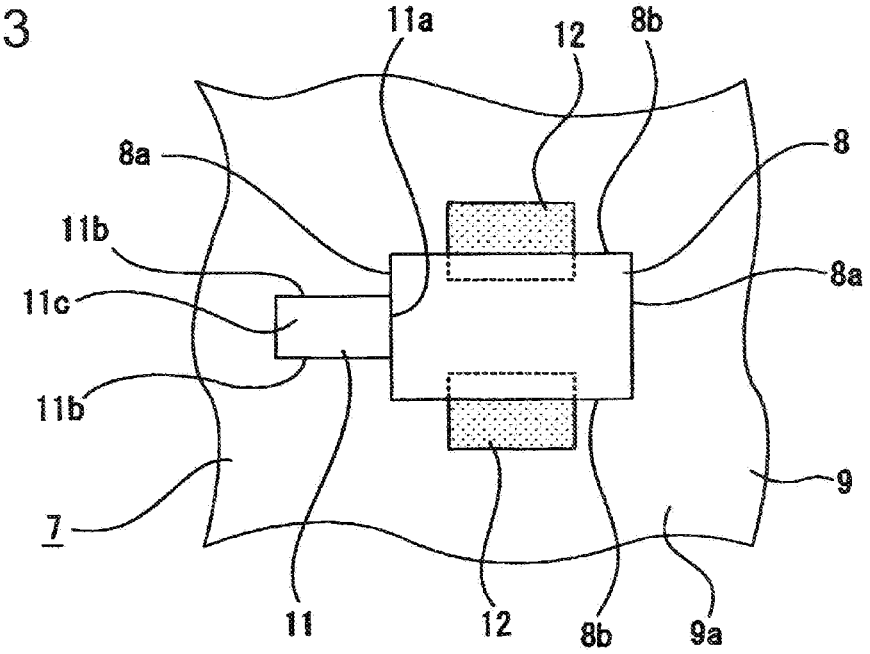
FIG. 3 is an enlarged rear view of a part of the light source unit thereof.

The solders 12 are located so as to be separated from each other in a direction perpendicular to a direction along which the light source 8 and the holding protrusion 11 are provided next to each other (see FIG. 3).

In the vehicular lamp 1 configured as described above, a drive voltage is applied from a power supply circuit (not shown) to each of the light sources 8 of the light source unit 6. Light beams are emitted from those light sources 8 to which the drive voltage has been applied, and thus the vehicular lamp 1 functions as a turn signal lamp, a tail lamp, a stop lamp, etc. according to the positions of the emitted light beams, the number of light beams, etc.

A process of mounting the light sources 8 onto the wiring board 7 by reflow soldering will be described below with reference to FIG. 4.

First, the wiring board 7 is placed on a transfer surface 100*a* of a transfer portion 100 that transfers the wiring board 7 to a reflow oven. At this time, the first surfaces 9*a* and the second surfaces 10*a* of the wiring board 7 face obliquely upward so that the overall height of the wiring board 7 is lower than the height of a loading port of the reflow oven.

Then, in the state described above, the solders (solder paste) 12 having appropriate viscosity are applied to each first surface 9*a*. The solders 12 are, in the shown example, applied to two spots for each light source 8 that are located on the side toward which the contact surface 11*a* faces with respect to the holding protrusion 11 and that are separately located from each other in a direction along which the two side surfaces 11*b* and 11*b* are arranged, that is, in the direction perpendicular to the direction along which the holding protrusion 11 and the light source 8 are arranged (or positioned next to each other).

The solders 12 are applied to two spots in the proximity of the holding protrusion 11. and, as described above, the solders 12 and 12 are separately located from each other in the direction perpendicular to the direction along which the holding protrusion 11 and the light source 8 are arranged. Accordingly, the holding protrusion 11 does not interfere with the application positions of the solders 12 and 12 on the first surface 9*a* and thus, the operation of applying the solders 12 to the first surface 9*a* can be easily and smoothly performed.

Next, the light source 8 is placed so as to extend between the two solders 12 and, 12. At this time, one of the first surfaces 8*a* of the light source 8 is in surface contact with the contact surface 11*a* of the holding protrusion 11, and a holding force of the solders 12 is applied to the light source 8 due to the viscosity of the solders 12.

Figure 4:
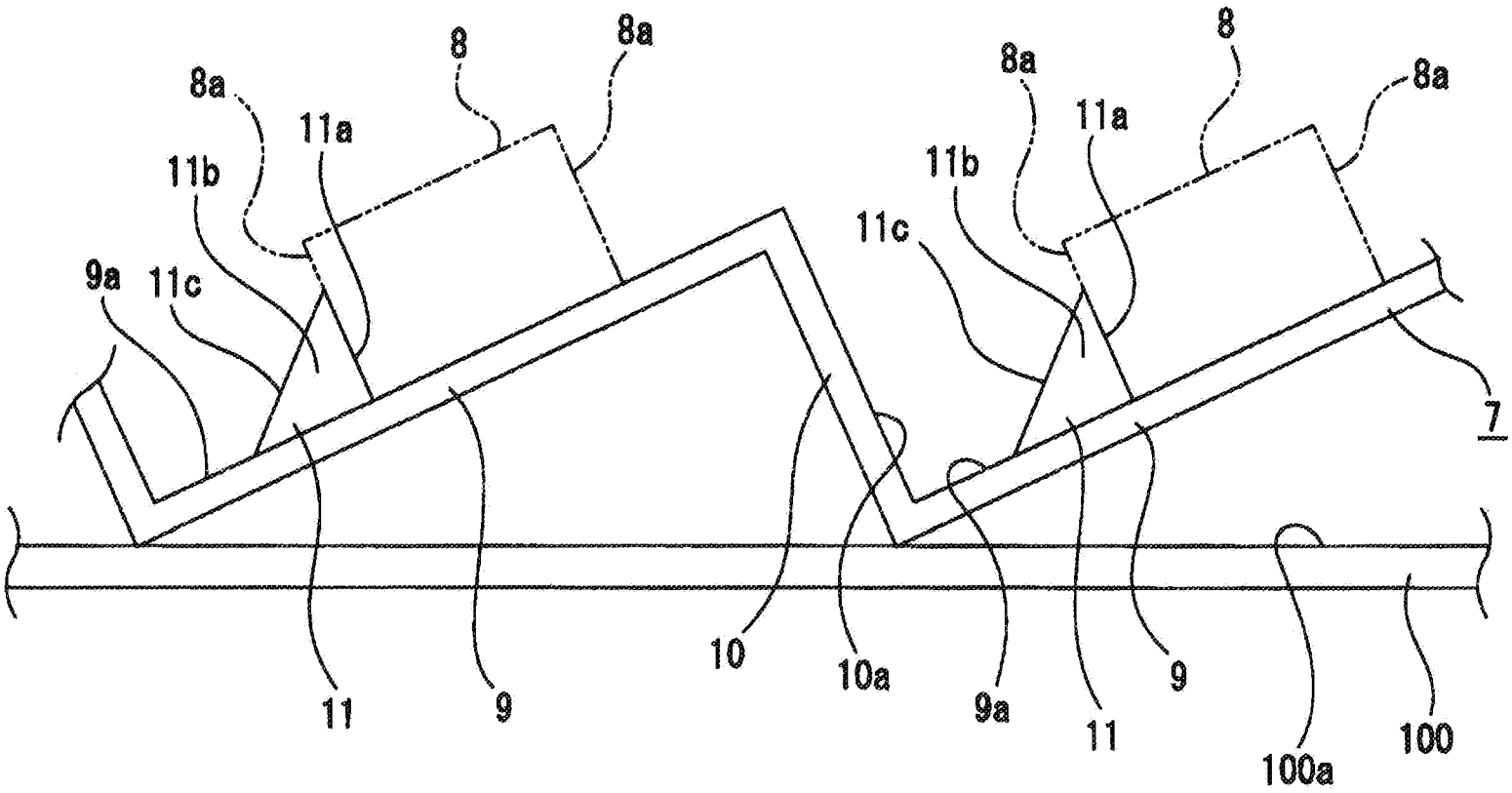
FIG. 4 is a conceptual diagram showing a state in the process of mounting light sources (electronic parts) onto a wiring board by reflow soldering.

In the above description, because the light source 8 is provided, as seen from FIG. 4, at a position where the light source 8 is pressed against the holding protrusion 11 by gravity, displacement of the light source 8 with respect to the wiring board 7 and dropping of the light source 8 from the wiring board 7 are prevented with a simple configuration.

Moreover, since the contact surface 11*a* of the holding protrusion 11 is, as seen from FIGS. 2 and 4, in surface contact with the first side surface 8*a* of the light source 8, stable holding of the light source 8 by the holding protrusion 11 is ensured.

Then, with all the light sources 8 set on the wiring board 7, the wiring board 7 is transferred to the reflow oven by the transfer portion 100, and the solders 12 are heated and melted in the reflow oven.

The solders 12 have a reduced holding force for the light source 8 when melted. However, since the light source 8 is held by being pressed against the holding protrusion 11, displacement of the light source 8 with respect to the wiring board 7 and dropping of the light source 8 from the wiring board 7 are prevented.

Then, the wiring board 7 having the light sources 8 mounted thereon is removed from the reflow oven, and the solders 12 are cooled. The melted solders 12 are solidified, whereby the light sources 8 are bonded to the solders 12 and are connected to the circuit pattern formed on the wiring board 7.

In the above example, displacement of each light source 8 with respect to the wiring board 7 etc. is prevented by the single holding protrusion 11 that has the contact surface 11*a* against which the light source 8 is pressed by gravity. However, the holding protrusion can be configured as shown in, for example, FIG. 5.

Figure 5:
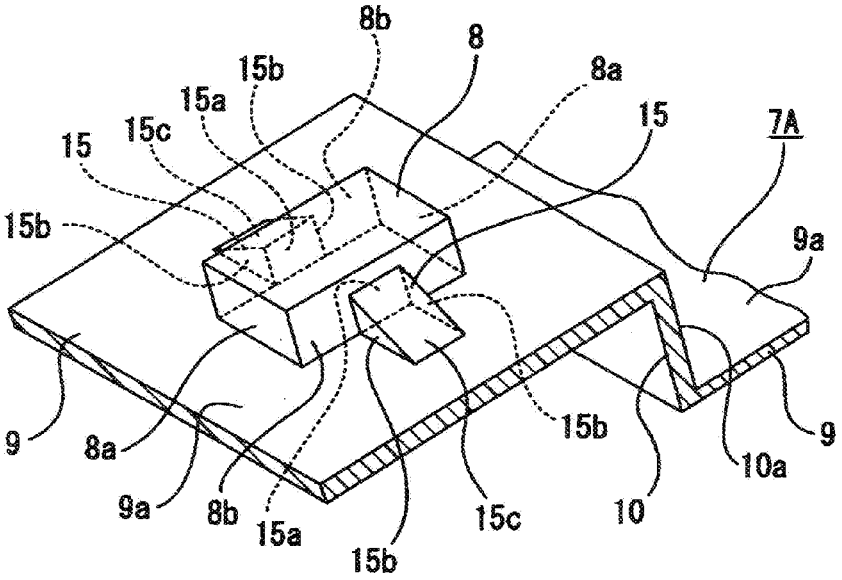
FIG. 5 is an enlarged perspective view of a modification of holding protrusions of the present invention.

In the example of FIG. 5, two holding protrusions 15 and 15 having the same shape as the holding protrusion 11 described above are provided on the first surface 9*a* of a wiring board 7A so as to be separately located from each other in a direction that is perpendicular to a direction in which gravity applies. The holding protrusions 15 and 15 are located so that their respective contact surfaces 15*a* and 15*a* face each other, and the interval between the contact surfaces 15*a* and 15*a* is the same as that between the two second side surfaces 8*b*, and 8*b* of the light sources 8. The light source 8 is inserted between the two holding protrusions 15 and 15 and is held between the two holding protrusions 15 and 15 with the contact surfaces 15*a* and 15*a* in contact with the second side surfaces 8*b* and 8*b* of the light source 8.

Holding the light source 8 by the pair or holding protrusions 15 and 15 in this manner eliminates the need for providing the holding protrusion at the position facing the first side surface 8*a*, and thus can increase the freedom of design choice with respect to the position where the circuit pattern is formed.

In the above example, the holding protrusions 15 and 15 are arranged in the direction perpendicular to the direction in which the gravity is applied. However, a desired number and positions of holding protrusions can be set as long as each light source 8 is held by a holding protrusion(s).

Figure 6:
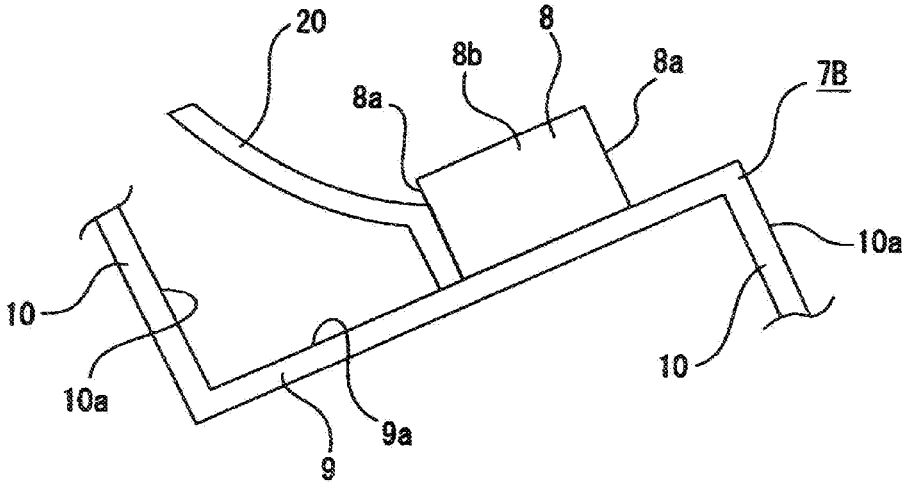
FIG. 6 is an enlarged side view of an example in which an optical part is used as the holding protrusion of the present invention.

In the above examples, the dedicated holding protrusion or protrusions 11, 15 are provided to prevent displacement of the light source 8 with respect to the wiring board 7, 7A, etc. However, as seen from FIG. 6, an optical part such as a reflector, a light guide, or a shade can be used as the holding protrusion to prevent displacement of the light source 8 with respect to the wiring board 7, etc.

For example, a reflector 20 provided in the lamp casing 4 can be used as the holding protrusion on the first surface 9*a* of a wiring board 7B. The, and the light source 8 is held with the first side surface 8*a* thereof in contact with an end portion of the reflector 20.

Using the reflector 20 as the holding protrusion eliminates the need for the dedicated holding protrusion or protrusions that prevent displacement of the light source 8 with respect to the wiring board 7B and dropping of the light source 8 from the wiring board 7B. Thus, displacement of the light source 8 with respect to the wiring board 7B and dropping of the light source 8 from the wiring board 7B are prevented with a simplified structure.

In the above examples, the light sources 8 are mounted on the first surfaces 9*a* of the wiring board 7, 7A or 7B. However, even if various electronic parts such as a resistive element or a transistor are mounted on the first surfaces 9*a*, such various electronic parts including the resistive element can be held by the holding protrusions 11, 15 or by the optical parts such as the reflector 20 that function as the holding protrusions. Accordingly, in this case as well, displacement of the electronic parts such as the resistive element with respect to the wiring board 7, 7A or 7B and dropping of the electronic parts from the wiring board 7, 7A, or 7B can be prevented.

In the above examples, the holding protrusions 11, 15 are each in a triangular prism shape. However, the shape of the holding protrusions is not limited to the triangular prism. The holding protrusions can be formed in any shape such as a cylinder or a prism as long as the holding protrusions can hold the electronic parts such as light sources.

As described above, the vehicular lamp 1 of the present invention is provided with the holding protrusions 11, 15 that hold the light source 8 when the first surface 9*a* of the wiring board is tilted with respect to the horizontal direction, or is provided with optical parts such as the reflector 20 functioning as the holding protrusions. Thus, displacement of the light source 8 with respect to the wiring board 7, 7A or 7B and dropping of the light source 8 from the wiring board 7, 7A or 7B can be prevented.

Moreover, in the vehicular lamp 1 of the present invention, the height of the holding protrusion 11, 15 from the first surface 9*a* is lower than that of the light source 8 from the first surface 9*a*.

Accordingly, each holding protrusion 11, 15 does not block so much of the light emitted from the light source 8, and a satisfactory lighting state of the light source 8 can be ensured.

Moreover, each holding protrusion 11, 15 is formed in a triangular prism shape having the tilted surface 11*c*, 15*c* that is tilted toward the first surface 9*a* as the distance from the contact surface 11 and 15 increases. Thus, the light emitted from the light source 8 is less likely to be blocked by each tilted surface 11*c*, 15*c*, and a more satisfactory lighting state of the light source 8 can be ensured.

The shape and structure of each constituting element described in the above show only one embodiment for carrying out the present invention and should not be construed as limitations to the technical scope of the present invention.

The invention claimed is:

1. A vehicular lamp comprising:

a lamp casing formed by a lamp housing having an opening on at least one side thereof and a cover attached to the lamp housing and closing the opening; and a light source unit disposed in the lamp casing and having a wiring board having a first surface and a second surface which face different directions, and a light source mounted on the first surface, a holding protrusion that holds the light source is provided on the first surface of the wiring board, and the holding protrusion is in surface contact with a side surface of the light source, wherein the light source is connected to the wiring board via solders, and wherein the solders are located so as to be separated from each other in a direction perpendicular to a direction along which the light source and the holding protrusion are provided next to each other.

2. The vehicular lamp according to claim 1, wherein the light source is a semiconductor light emitting element, and a height of the holding protrusion from the first surface is lower than that of the semiconductor light emitting element from the first surface.

3. The vehicular lamp according to claim 1, wherein when mounted on the first surface, the light source is set at a position where the light source is pressed against the holding protrusion by gravity.

4. The vehicular lamp according to claim 1, wherein the wiring board is a molded interconnection device.

5. The vehicular lamp according to claim 1, wherein an optical part of the vehicular lamp is used as the holding protrusion.

6. The vehicular lamp according to claim 1, wherein the wiring board is a molded interconnection device, the light source is a semiconductor light emitting element, the light source, when mounted on the first surface, is set at a position where the light source is pressed against the holding protrusion by gravity, a height of the holding protrusion from the first surface is lower than that of the semiconductor light emitting element from the first surface, and an optical part of the vehicular lamp is used as the holding protrusion.

7. The vehicular lamp according to claim 1, wherein the holding protrusion is formed integrally with a base portion of the wiring board.

8. The vehicular lamp according to claim 1, wherein the wiring board has a stepped configuration including a plurality of steps therein, wherein the first surface and second surface form the sides of each step in the plurality, and wherein a light source is mounted the first surface of each step in the plurality.

* * * * *